US005980140A

United States Patent [19]

Gutsell et al.

[11] Patent Number: 5,980,140

[45] Date of Patent: Nov. 9, 1999

[54] TAPE PRINTING APPARATUS AND TAPE HOLDING CASE HAVING COOPERATIVE SURFACE

[75] Inventors: Graham Scott Gutsell, Hartson; Charles Robert Sims, Fowlmere, both of United Kingdom

[73] Assignee: Esselte N.V., Sint-Niklaas, Belgium

[21] Appl. No.: 09/142,564

[22] PCT Filed: Mar. 7, 1997

[86] PCT No.: PCT/GB97/00644

§ 371 Date: Sep. 11, 1998

§ 102(e) Date: Sep. 11, 1998

[87] PCT Pub. No.: WO97/33755

PCT Pub. Date: Sep. 18, 1997

[30] Foreign Application Priority Data

Mar. 13, 1996 [GB] United Kingdom ..... 9605324

[51] Int. Cl.[6] ..... B41J 15/08

[52] U.S. Cl. ..... 400/613; 400/615.2

[58] Field of Search ..... 400/613, 613.3, 400/615.2, 642, 679, 83, 85

[56] References Cited

U.S. PATENT DOCUMENTS

| | | | |
|---|---|---|---|
| 4,914,452 | 4/1990 | Fukawa | 400/613 |
| 5,183,333 | 2/1993 | Minowa | 400/605 |
| 5,201,588 | 4/1993 | Sakai et al. | 400/613 |
| 5,458,423 | 10/1995 | Sims et al. | 400/621 |
| 5,496,119 | 3/1996 | Kawakami et al. | 400/70 |
| 5,503,482 | 4/1996 | Kawakami et al. | 400/83 |
| 5,620,268 | 4/1997 | Yamaguchi et al. | 400/613 |
| 5,760,814 | 6/1998 | Kang | 400/613 |

FOREIGN PATENT DOCUMENTS

| | | |
|---|---|---|
| 0 451 830 | 10/1991 | European Pat. Off. . |
| 0 578 372 | 1/1994 | European Pat. Off. . |
| 0 622 215 | 11/1994 | European Pat. Off. . |
| 0 661 649 | 7/1995 | European Pat. Off. . |

*Primary Examiner*—John Hilten
*Assistant Examiner*—Leslie J. Grohusky
*Attorney, Agent, or Firm*—Pennie & Edmonds LLP

[57] ABSTRACT

A tape printing apparatus arranged to be used with a tape holding case. The case holds a first supply of image receiving tape and a second supply of laminating tape. An opening is provided between the first and second tape supplies. A printing mechanism is arranged to print an image onto the image receiving tape as it traverses the opening. A cutting location is provided where the image receiving tape is cut after an image has been printed thereon. The cutting location and printing mechanism lie on opposite sides of the first and second tape supplies.

21 Claims, 5 Drawing Sheets

TAPE PRINTING APPARATUS AND TAPE HOLDING CASE HAVING COOPERATIVE SURFACE

TECHNICAL FIELD

The invention relates to a tape printing apparatus which operates with a supply of tape which may be provided in a tape holding case. The invention is particularly but not exclusively concerned with a tape printing apparatus which provides a printed image with a protected layer thereover. The invention is also concerned with printing images in a plurality of different colours.

BACKGROUND ART

Tape printing apparatus of the general type with which the present invention is concerned are disclosed in EP-A-322918 and EP-A-322919 (Brother Kogyo Kabushiki Kaisha) and EP-A-0267890 (Varitronics). These printers each include a printing device having a cassette receiving bay for receiving a cassette or tape holding case. In EP-A-0267890, the tape holding case houses ink ribbon and a substrate tape, the latter comprising an upper image receiving layer secured to a backing layer by adhesive. In EP-A-322918 and EP-A-322919, the tape holding case houses an ink ribbon, a transparent image receiving tape and a double sided adhesive tape which is secured at one of its adhesive coated sides to the image tape after printing and which has a backing layer peelable from its other adhesive coated sides. The image is printed on the side of the image receiving tape which is adhered to the adhesive coated tape. Thus, the printed image is covered by a protective layer. With both of these apparatus, the image transfer medium, (ink ribbon) and image receiving tape (substrate) are in the same cassette.

The present applicants have developed a different type of printing apparatus which is described for example in European patent application No. 578372. In this printing apparatus, the substrate tape is similar to that described in EP-A-0267890 but is housed in its own tape holding case whilst the ink ribbon is similarly housed in its own tape holding case.

Reference is also made to JP-A-2204074 which discloses an ink cartridge having removable shafts holding an ink supply.

In all of these cases, the image receiving tape passes in overlap with the ink ribbon through a print zone consisting of a fixed print head and a platen against which the print head can be pressed to cause an image to transfer from the ink ribbon to the image receiving tape. There are many ways of doing this, including dry lettering or dry film impression, but the most usual way at present is by thermal printing where the print head is heated and the heat causes ink from the ink ribbon to be transferred to the image receiving tape.

As discussed above, all of the above mentioned apparatus use a fixed print head. This is disadvantageous when it is desired to print on labels having a relatively large width or where the same apparatus is designed to be used with a number of different widths of tape. In the first situation, the print head would need to be as wide as the maximum width of the tape. Thus with large widths of tape, the fixed print head would also have to be relatively large. Large print heads are relatively expensive and accordingly increase the cost of the apparatus. Additionally, with large print heads, the power required to activate the large number of printing elements on such a print head can be disadvantageous for battery operated arrangements. If the arrangement is mains powered the associated components can be costly. This is a particular problem where a large percentage of the printing elements on the print head are operated at the same time.

In the second situation discussed above, the print head would have to have the same size as the largest width of tape designed to be used with the tape printing apparatus. If such apparatus are only rarely used with the maximum width of tape, the associated additional cost of having a print head capable of printing on large widths of tapes would not be justified.

Accordingly such apparatus would be unnecessarily expensive or would not be arranged to have the flexibility to print on a wide range of different width tapes. The associated disadvantages with a large print head of cost would also be present with this second situation.

A further disadvantage of using a fixed print head is that multiple colour printing can be difficult to implement with a fixed print head as the image receiving tape would have to be moved back and forth past the print head. Alignment of the images in the different colours may be difficult to achieve reliably.

SUMMARY OF THE INVENTION

According to a first aspect of the present invention, there is provided a tape printing apparatus in combination with a tape holding case, wherein said tape printing apparatus comprises means for receiving a tape holding case, a printing mechanism for printing an image on an image receiving tape and a cutting location at which said image receiving tape is cut after an image has been printed thereon, said tape holding case holding a supply of image receiving tape and a supply of a different tape, said tape supplies being aranged on either side of an opening of the tape holding case, wherein said printing mechanism is operable to print an image on said image receiving tape as it traverses said opening, and said cutting location and printing mechanism lie on opposite sides of said first and second tape supplies.

The opening between the tape supplies may extend completely between the two tape supplies. Alternatively the opening may be open on one side only of the tape supplies. Thus, the opening may be closed off on one side of the two tape supplies.

The second tape may be a different type of image receiving tape, a laminating tape or an ink ribbon.

The arrangement may minimise the distance between the printing mechanism and the cutting location at which the imagereceiving tape is cut. Thus, the leading and trailing margins for a label can be minimised, resulting in a reduction in tape wastage.

According to a second aspect of the present invention, there is provided a tape printing apparatus comprising:

means for receiving a supply of image receiving tape capable of being drawn therefrom for printing;

a printing mechanism for printing an image onto said image receiving tape comprising an array of printing elements extending generally lengthwise of the image receiving tape, said printing mechanism being movable in the direction generally widthwise of the image receiving tape;

a platen against which the image receiving tape is retained during printing; and means for drawing said image receiving tape from the supply for printing.

Thus, by using a printing mechanism which is able to move across the width of the image receiving tape, a range of different sized tapes can be used with the tape printing apparatus without having to increase the size of the print head with associated increase in costs. Thus, embodiments of the present invention are able to print wide labels without difficulty.

Preferably, the surface of the platen against which the image receiving tape is retained during printing is substantially planar. By using a planar surface, it has been found that a good quality of print on the image receiving tape can be achieved as the printing mechanism moves relative to the image receiving tape.

Preferably, the platen is non-rotatable. In some embodiments, the platen may be rotatable and may be in the form of a roller. However, it has been found that a non-rotatable platen assists in achieving good print quality on the image receiving tape.

The length of the platen is preferably equal to or greater than the width of the image receiving tape. Where more than one width of image receiving tape is used, the platen length is preferably equal to or greater than the width of the widest image receiving tape. Thus, the image receiving tape can be supported across its entire width by the platen as the printing mechanism moves there across. This feature may assist in obtaining good print quality.

In one embodiment of the present invention, the tape printing apparatus further comprises means for receiving a supply of protective tape and means for applying said protective tape to the image receiving tape after an image has been printed on said image receiving tape, said protective tape overlying the printed image. The image may be in a mirror orientation or a normal image. By providing a protective tape layer over the printed image, the durability of the resulting labels provided by the tape printing apparatus can be improved. The protective tape may be transparent or opaque depending on whether the printed image is to be read through the protective tape or through the image receiving tape.

The drawing means preferably constitutes said means for applying said protective tape to the image receiving tape. In this way, the number of components of the tape printing apparatus can advantageously be reduced leading to a reduction in the cost and complexity of the apparatus.

The drawing means may comprise a rotatable roller which drives the image receiving tape through said apparatus. As discussed above, this roller can also be used to apply a protective layer to the image receiving tape.

The tape printing apparatus is preferably arranged to accommodate a tape holding case comprising a first supply of image receiving tape and a second supply of a different type of tape. However, it should be appreciated that only a single supply of image receiving tape can be provided in the tape holding case. If appropriate, a further tape holding case may be provided to house the second supply of tape. The second supply of tape is preferably a supply of protective tape or laminating tape which is applied to image receiving tape after an image has been printed thereon. In some embodiments, the laminating tape may not be required. The second tape supply may alternatively be ink ribbon. It is also envisaged that in some embodiments, the only tape provided will be the image receiving tape.

In a particularly preferred embodiment of the present invention, the drawing means cooperate against an external surface of the tape holding case to draw said image receiving tape from said supply. Alternatively, the drawing means may cooperate with a roller. At the same time, the drawing means may apply the protective layer to the image receiving tape.

By using a surface of the tape holding case and the drawing means of the tape printing apparatus to drive the image receiving tape through the apparatus and to apply the protective layer to the image receiving tape, the need to provide rollers in the tape holding case for the image receiving layer and/or the protective tape can be avoided. This simplifies the construction of the tape holding case and thus reduces its cost. Additionally, by using a surface of the tape holding case against which the drawing means acts, the number of parts in the tape printing apparatus itself can be reduced, reducing the cost of the tape printing apparatus and increasing its reliability.

Preferably, the tape printing apparatus has means for receiving a tape holding case having a supply of ink ribbon which is used to provide an image on said image receiving tape during printing, said tape holding case being mounted so as to move with said printing mechanism. Alternatively, it will be appreciated that a fixed supply of ink ribbon can be used which extends along the entire path of movement for the printing mechanism. However, by using a tape holding case which moves with the printing mechanism, the size of the tape holding case for the ink ribbon could be reduced. Additionally, problems with tangling and jamming of the ink ribbon can be minimised.

By using a printing mechanism which moves relative to the image receiving tape, it is advantageously possible to print an image in different colours with embodiments of the present invention. For example, ink ribbon may be provided, said ink ribbon having a plurality of different coloured panels extending, in succession, along the lengthwise direction of said ink ribbon, said apparatus comprising means for advancing said ink ribbon, wherein an image in each of the different colours can be printed on the same region of the image receiving tape.

Preferably said ink ribbon is advanced stepwise with each step substantially corresponding to the length of each panel measured in the lengthwise direction of said ink ribbon. Preferably the image receiving tape is advanced stepwise by a distance substantially corresponding to the length or height of the printing mechanism. Preferably, the ink ribbon extends lengthwise in the widthwise direction of the image receiving tape as the width of the ink ribbon may then be less than that of the image receiving tape. It will be appreciated that where the width of the ink ribbon is less than the length of the printing mechanism, the steps for advancing the image receiving tape may be of the same size as the width of the ink ribbon.

However in certain embodiments of the invention, the ink ribbon extends lengthwise along the lengthwise direction of the image receiving tape. In these latter embodiments, the image receiving tape and ink ribbon are preferably of a similar width.

In an alternative embodiment, the tape holding case may comprise an ink ribbon having a plurality of bands each extending along the length of said ink ribbon, said bands being of different colours, wherein the means for drawing said image receiving tape advances said image receiving tape stepwise with each step being of a distance substantially corresponding to a width of each band of colour. In this embodiment, the ink ribbon may be arranged to extend lengthwise in a direction widthwise of the image receiving tape.

In order to obtain full colour printing, the ink ribbon preferably comprises sections of the following three colours: cyan; magenta and yellow. In this way, full colour printing may be achieved. Additionally, in some embodiments of the invention, the ink ribbon may comprise a fourth section which is black. However, it will be appreciated that the ink ribbon may be of a single colour or of a plurality of different colours. The different colours may be provided on a single ink ribbon or separate ink ribbons. The separate ink ribbons may be provided in separate tape holding cases or a single tape holding case.

The tape printing apparatus may have two modes of operation so as to print in monochrome in a first mode of operation and in multiple colour in the second mode of operation. When it is desired to print an image on the image receiving tape in a single colour, the print head does not need to pass over the same region of the image receiving tape more than once. Accordingly, in the first mode of operation, the print head will only pass over each region of the image receiving tape once. However, when it is desired to provide a multi-colour image, the print head will pass over the same region of the tape by number equal to the number of different colours. For example, for a four colour tape, the print head would pass over the same part of the image receiving tape four times. A switch or sensing means would be provided in order to indicate to a print head controller the number of colours of ink ribbon.

The printing mechanism preferably has a printing mode of operation in which said printing mechanism is arranged to print an image on said image receiving tape as the printing mechanism moves relative to the image receiving tape in a first direction and has a non-printing mode of operation in which the printing mechanism moves in a second direction, opposite to the first direction, relative to the tape. It will be appreciated that in certain embodiments of the invention, the print head can be arranged to also print as it moves in said second direction.

The printing mechanism preferably has a printing mode of operation in which said printing mechanism is arranged to print an image on the image receiving tape and a second non-printing mode of operation, wherein the image receiving tape is advanced through the apparatus by said drawing means in the non-printing mode of operation and said image receiving tape is stationary during the printing mode of operation. By having the image receiving tape stationary during printing, the control of the printing mechanism is simplified, thus reducing the complexity of the printing mechanism and its cost. However, in certain embodiments of the present invention, the tape can also be moved during the printing mode of operation. If the tape is moving during printing, means may be provided for controlling the speed of the tape and/or for monitoring the speed thereof.

At least one of the printing mechanism and the platen may be biased towards the other of said printing mechanism and platen. In this way, it can be ensured that the image receiving tape contacts the printing mechanism with a constant force, thus providing an even quality of print. The platen may have an elastomeric surface against which the image receiving tape is retained during printing. This feature also helps to ensure that the image receiving tape is biased against the print head with an equal force. This permits a good quality of print to be obtained.

The printing mechanism preferably comprises a thermal print head.

The tape printing apparatus preferably has first and second parts with the printing mechanism being mounted in said first part and the platen being mounted in said second part, said first and second parts being separable to allow the insertion of the image receiving tape between said printing mechanism and said platen. This feature is particularly useful where a large clearance has to be provided between the printing mechanism and platen to allow the image receiving tape, possibly in a tape holding case, to be inserted therebetween. By separating the parts in which the printing mechanism and platen are mounted respectively, this clearance can be achieved. In the prior art, the print head and/or platen are arranged to be movable relative to one another. However, the print head and platen are generally mounted on a single part and cannot therefore be separated by relatively large distances which can, in contrast, be achieved by embodiments of the present invention.

The drawing means may be arranged to act against a surface to drive the image receiving tape through the tape printing apparatus, said drawing means being mounted in one of first and second parts of the tape printing apparatus, said first and second parts being separable wherein separation of the first and second parts provides a gap between the drive means and said surface whereby the image receiving tape can be inserted between said drive means and said surface. The surface may be provided on a tape holding case housing tape. By having separable first and second parts of the apparatus, a relatively large clearance can be achieved between the drawing means and the surface which can make the apparatus relatively simply to use, as compared to the prior art.

According to a third aspect of the present invention, there is provided a tape printing apparatus arranged to receive a supply of image receiving tape and having a printing mechanism for printing an image onto said image receiving tape, said printing mechanism cooperating with a surface during a printing operation, said apparatus further comprising first and second parts with said printing mechanism being mounted in said first part and said surface being mounted in said second part, said first and second parts being separable to allow insertion of said image receiving tape between said printing mechanism and said surface.

As discussed above, by having the printing mechanism mounted in one part of the tape printing apparatus and the surface against which said printing mechanism cooperates during printing mounted in a second different part of the tape printing apparatus and with the first and second parts of the tape printing apparatus being separable, the insertion of the image receiving tape between the printing mechanism and its associated surface is simplified. This is of particular advantage in those embodiments where at least part of a tape holding case containing a supply of image receiving tape needs to pass between the printing mechanism and its cooperating surface to be inserted.

The printing mechanism is preferably movable across the image receiving tape to thereby print an image thereon. In this way, the advantages associated with certain aspects of the first aspect of the present invention can be achieved.

Preferably, drive means and a cooperating surface are provided to drive the image receiving tape through the tape printing apparatus, the drive means being mounted in one of said first and second parts of the tape printing apparatus wherein separation of the first and second parts defines a gap between the drive means and said surface whereby the image receiving tape can be inserted between said drive means and said surface. The surface may be provided by a surface of the tape holding case. By permitting the drive means and its associated surface to be in effect separated, the insertion of the image receiving tape therebetween is simplified and eased. Again this feature is advantageous in those embodiments which require at least part of an image receiving tape to pass between the drive means and the surface.

According to a fourth aspect of the present invention, there is provided a tape printing apparatus arranged to receive a supply of image receiving tape and having drive means and a surface, said drive means acting against said surface to drive the image receiving tape through the tape printing apparatus, said drive means being mounted in a first part of the tape printing apparatus and said first and second parts being separable to define a gap between the drive means and said surface whereby the image receiving tape can be placed between said drive means and said surface.

Preferably in either of the third or fourth aspects, means for receiving a tape holding case holding a supply of image receiving tape are provided and said tape holding case provides said surface which cooperates with the drive means. By having this surface forming part of the tape holding case, the number of parts of the tape printing apparatus can be reduced. Also, as the tape holding case provides said surface and the tape holding case will be replaced from time to time, it is not necessary to make the surface particularly durable. This again leads to a decrease in the cost of the tape printing apparatus and its associated tape holding case.

The tape holding case preferably comprises a supply of protective tape to be applied to the image receiving tape after an image has been applied thereto wherein said drive means and its associated surface are further arranged to apply the protective tape to said image receiving tape. By using the drive means to apply the protective tape to the image receiving tape, the number of components of the tape printing apparatus can be reduced thereby reducing the cost of the tape printing apparatus as a whole.

Preferably in either of the third or fourth discussed aspects, means are provided for receiving a tape holding case comprising a supply of image receiving tape, wherein the separation of the first and second parts allows said tape holding case to be inserted in said tape printing apparatus.

Preferably, the two parts are hingedly connected to each other. However, in certain embodiments the two parts may be completely separable or connected to one another by any suitable mechanism.

According to a fifth aspect of the present invention, there is provided a tape holding case comprising a supply of an image receiving tape and a supply of a second different type of tape, said tape holding case having an aperture with said first supply on one side of said aperture and the second supply on a second opposite side of said aperture whereby in use one of the tapes is arranged to traverse said aperture.

An image may be applied to said image receiving tape as said image receiving tape traverses said aperture.

Preferably, each of the tape supplies is covered by a substantially cylindrical protective casing. This provides some flexibility in the manufacture of the tape holding case in that different sleeves may be provided for use with different tape holding cases. Thus, the number of different components required to assemble a tape holding case can be reduced where a range of different tape holding cases is to be provided. It should be appreciated that any suitable shape can be used for the sleeves.

The second different type of tape may comprise a protective layer to be adhered to the first tape after an image has been printed thereon. This protective layer may be substantially transparent. Alternatively, the layer may be opaque if the image is to be viewed through the image receiving tape itself. As discussed above, the protective layer can increase the durability of produced labels.

The tape holding case preferably has an outer surface portion for cooperating with tape drawing means of a tapeprinting apparatus. The outer surface portion may be convex so as to cooperate with drawing means in the form of a roller.

Preferably, the tape holding case comprises a region at which an image is printed on said image receiving tape and an exit for said image receiving tape, said exit and printing region being adjacent one another with the supplies of tapes being arranged on opposite sides respectively of said exit and printing region. By having the tape supplies arranged either side of the exit and printing region, the distance between the printing region and the exit can be minimised. This is particularly advantageous where a cutting mechanism is provided ajacent the exit as the leader and trailer lengths for a label can be minimised, thus reducing tape wastage.

According to a sixth aspect of the present invention, there is provided a tape supply assembly supporting device for a tape printing apparatus comprising a support member arranged to support a first spool of tape and a second spool of tape, contained within a respective individual casing. The casings are preferably independently removable.

Preferably, the casings are substantially cylindrical but can alternatively be of any other suitable shape. One of the casings preferably has an outer surface portion which is shaped to cooperate with tape drawing means of a tape printing apparatus. The casing is preferably thickened in the region of said outer surface portion. This may ensure that a sufficient force is provided between the tape drawing means and the outer surface portion in order to draw the tape from a tape supply. The outer surface portion may be adjacent to an exit for at least one of the tape supplies. At least one of the tape supplies may be guided out of said casing by a curved wall portion of said casing. The curved wall portion may be provided by the thickened outer surface portion. The curving of the wall portion allows friction between the tape being drawn out of the casing and the casing to be reduced.

Preferably at least one support member is provided for supporting said supplies of tape, wherein at least one of said support members is arranged in use to be held in place between two parts of a tape printing apparatus in which said device is inserted. In this way the device can be retained in the correct position in a tape printing apparatus.

As will be appreciated, various features of the tape holding case and the supply assembly supporting device of the fifth and sixth aspects are interchangeable. In addition, the tape holding case and tape supply assembly supporting device as described in relation to the fifth and sixth aspects can be used in relation in any of the tape printing apparatus described in relation to the tape printing apparatus of the first to fourth aspects.

According to a seventh aspect of the present invention, there is provided a tape holding case for use with a tape printing apparatus, said tape holding case comprising:

- a supply of image receiving tape to which an image is to be applied;
- a supply of protective tape to be applied to the image receiving tape on a surface of the image receiving tape to which an image has been applied by the tape printing apparatus; and
- an opening lying between said supply of image receiving tape and said supply of protective tape, said image receiving tape being arranged to traverse said opening, whereby a printing mechanism of said tape printing apparatus is arranged to print an image on said image receiving tape as the image receiving tape traverses said opening.

According to an eighth aspect of the present invention, there is provided a tape holding case for use with a tape printing apparatus, said tape holding case comprising:

- a supply of image receiving tape to which an image is to be applied;
- a supply of protective tape to be applied to the image receiving tape on a surface of the image receiving tape to which an image has been applied by said tape printing apparatus; and a cooperating surface which in use is arranged to cooperate with a drive means of the tape printing apparatus to drive the image receiving tape through the tape printing apparatus and to apply the protective tape to the image receiving tape, said cooperating surface being on an external surface of a casing for at least one of said tape supplies.

As will be appreciated, any of the various features described in relation to the first to eighth aspects can be used, where appropriate, in combination with features of any of the other aspects.

It should be appreciated that each aspect constitutes a separate invention for which independent protection may be sought.

For a better understanding of the present invention and as to how the same may be carried into effect, reference will now be made by way of example to the accompanying drawings in which.

DETAILED DESCRIPTION OF THE PREFERRED EMBODIMENTS

Figure 1:
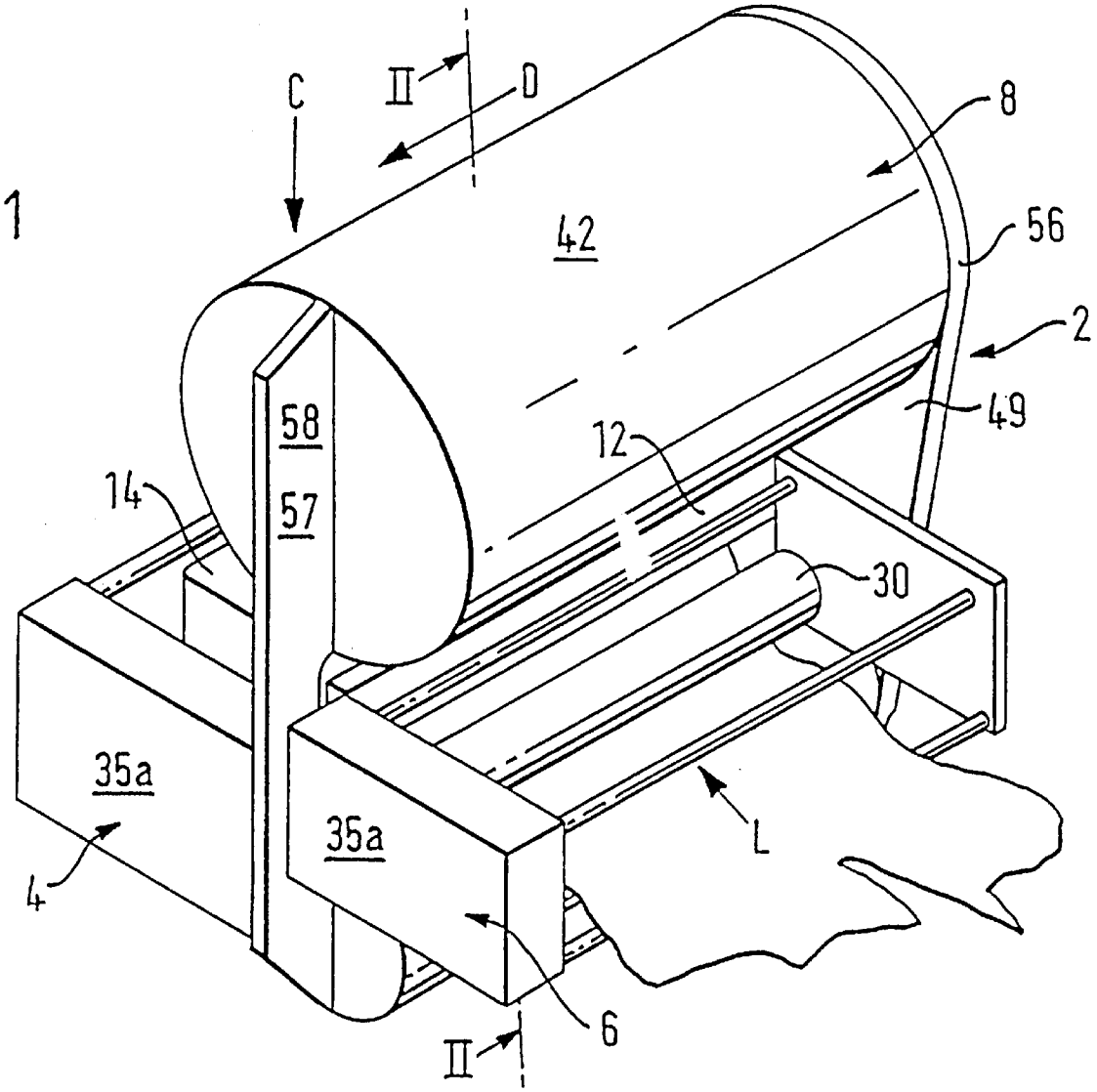
FIG. 1 shows a perspective view of a tape printing apparatus embodying the present invention.
Figure 2:
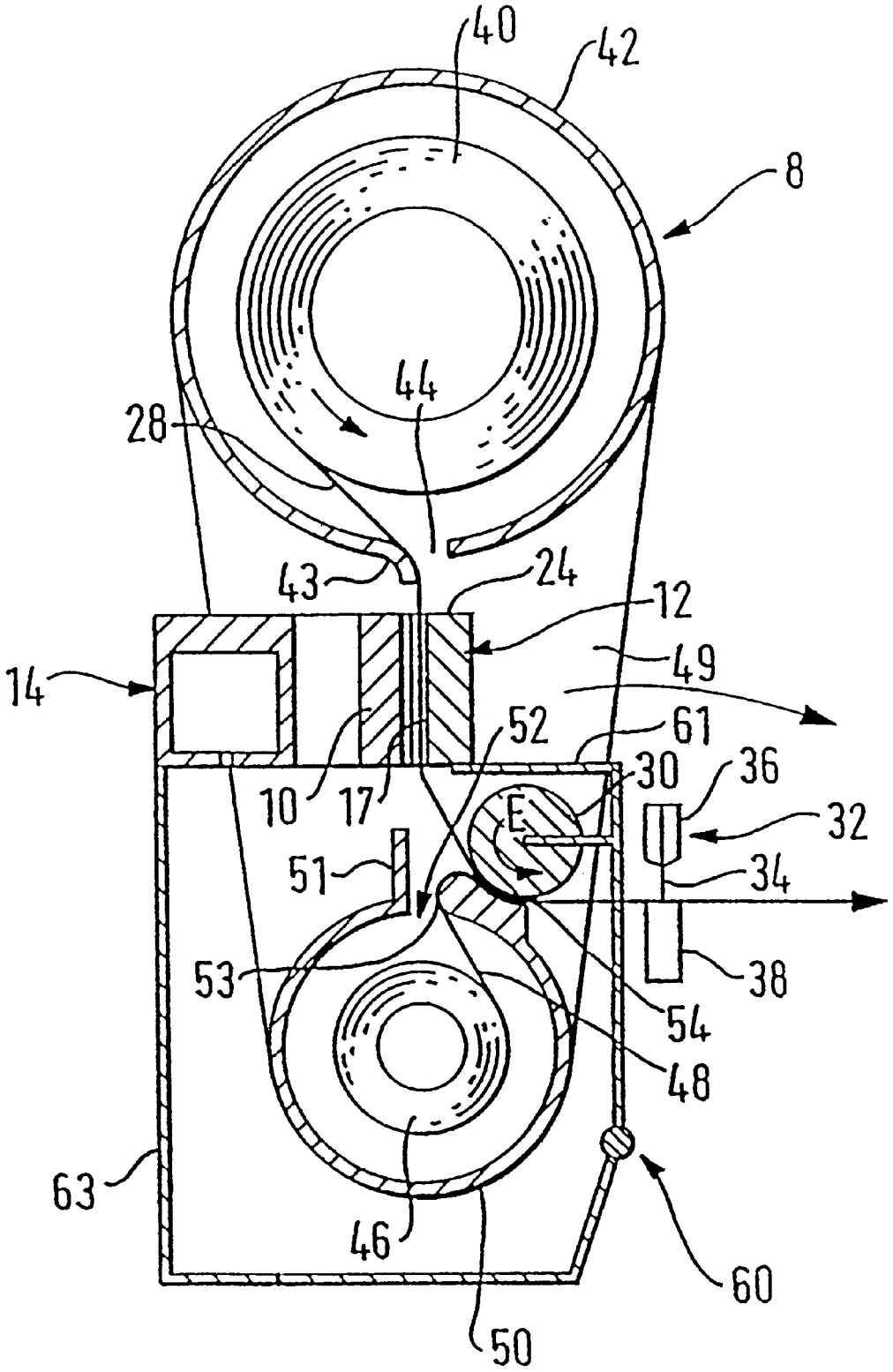
FIG. 2 shows a cross-sectional view of part of the apparatus of FIG. 1 along line II—II.
Figure 3:
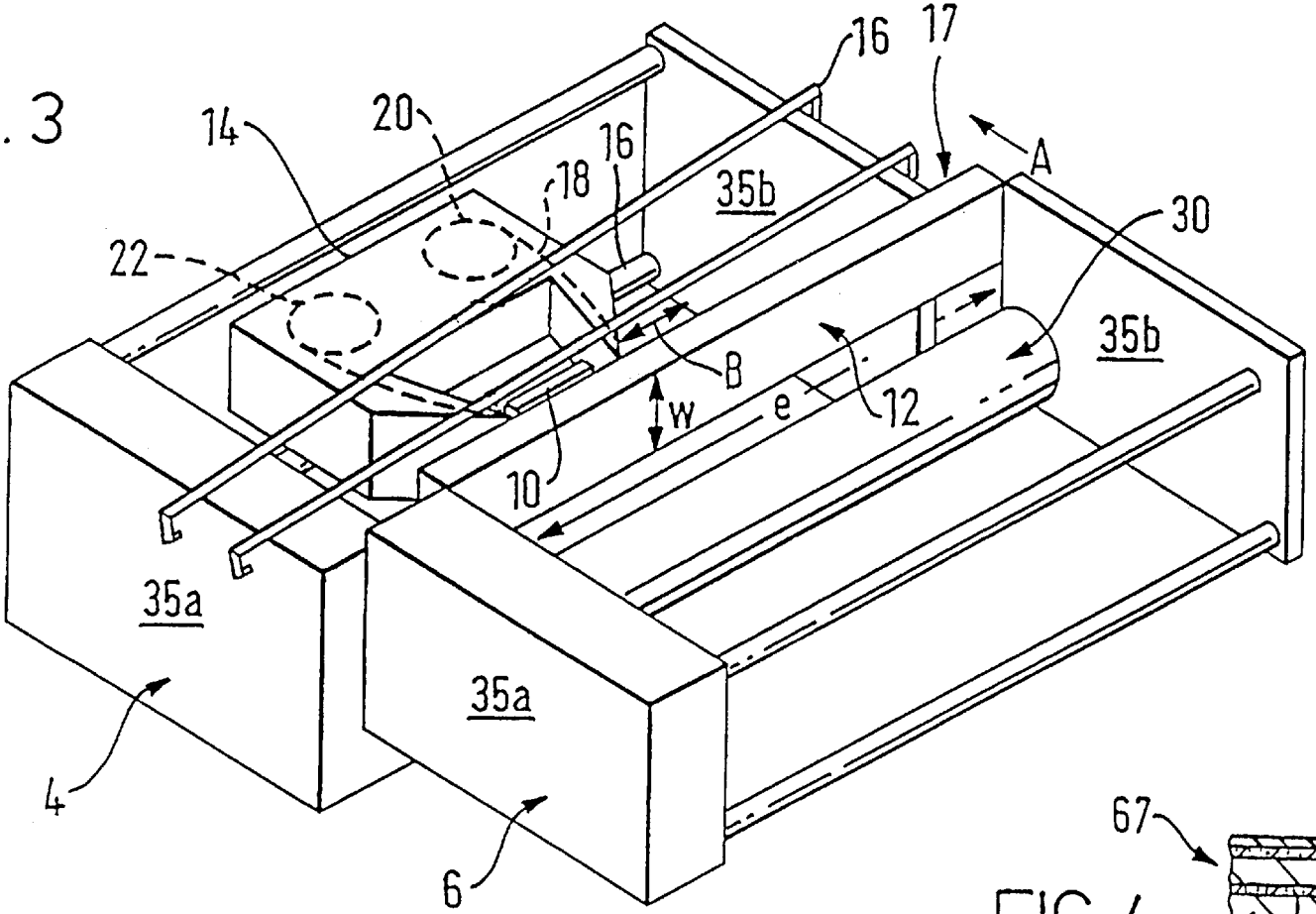
FIG. 3 shows a perspective view of the tape printing apparatus of FIG. 1 with image receiving tape and lamination tape supplies removed.

Reference will first be made to FIGS. 1 to 3 which show a tape printing apparatus 2 for printing labels comprising a print mechanism 4 and a drive/cut mechanism 6. Additionally, a tape holding case 8 holding a supply of image receiving tape 28 and a supply of laminating tape 48 is arranged in the tape printing apparatus 2 (see FIGS. 1 and 2).

The print mechanism 4 comprises a thermal print head 10 which has a column of printing elements, preferably one printing element wide, which are selectively heated to form an image on the image receiving tape 28. Each printing element, when activated forms a pixel of the printed image. In some embodiments of the invention however, the print head 10 may be provided with a column of printing elements two or more printing elements wide. The longitudinal axis of the column of printing elements of the print head 10 is arranged to extend parallel to the longitudinal axis L of the image receiving tape 28. The print head 10 moves across the width of the tape 28, perpendicular to the longitudinal axis L of the image receiving tape 28. However, in some embodiments of the invention, the column of printing elements will extend perpendicular to the longitudinal axis of the image receiving tape 28. Such an arrangement may be suitable for use with tapes having a width of a similar size to the height of the print head 10 or less.

The thermal print head 10 acts against a spring loaded pressure platen 12. The pressure platen 12 is biased in the direction of arrow A, that is towards the print head 10. However, the platen 12 need not be spring loaded. Alternatively, the print head 10 may itself be biased towards the platen 12. This latter variation may simplify the apparatus 2. In either case, the pressure platen 12 may have a compliant surface 17 made for example of rubber or another elastomer. This is to ensure that all parts of the image receiving tape 28 under the print head 10 are biased against the print head 10 with equal force.

The print head 10 is movably mounted to a guide mechanism (not shown) with one or more guide rails 16 and is arranged to move back and forth along the guide rails 16 in the direction of arrow B by a drive mechanism (not shown). The length of the guide rails 16 is selected to be equal to the travel distance of the print head 10 (roughly equal to the maximum width of image receiving tape 28 which can be used with the apparatus 2) plus the width of the print head 10 plus a small allowance for over travel. This is so as to allow the print head 10 to print over the entire width of the largest width of image receiving tape 28 to be used with the apparatus 2.

It should be appreciated that in some embodiments it may not be necessary that the print head 10 be able to print across the entire width of the image receiving tape 28 as margins may be required along the edges of any resulting label. In those embodiments, the length of the guide rails 16 may be less than in the preferred embodiments of the invention.

The pressure platen 12 is arranged to have a length e of similar dimensions to that of the maximum width of image receiving tape 28 which can be received in the tape printing apparatus. Typically, the image receiving tape 28 will be between 25 mm and 100 mm wide although larger and smaller sized tapes 28 may also be used. The pressure platen 12 has a width w equal to or greater than the height of the column of printing elements of the print head 10. As can be seen particularly clearly from FIGS. 2 and 3, the surface 17 of the pressure platen 12 which faces print head 10 is substantially planar and is non-rotatable.

An ink cassette 14 is also movably mounted to the guide rails 16 and is arranged to move with the print head 10 as it moves back and forth along the guide rails 16. The ink cassette 14 comprises an ink ribbon 18 which extends from a supply spool 20 to a take up spool 22, also in the ink cassette 14. As will be described in more detail hereinafter, the ink ribbon 18 passes in overlap with the image receiving tape 28 through a print zone 24 defined between the print head 10 and the pressure platen 12. In particular, the image receiving tape 28 from the tape holding case 8 passes through the print zone 24 between the pressure platen 12 and the inkribbon 18. The ink ribbon 18 has a width which is of a similar size to the height of the column of printing elements of the print head 10.

The ink cassette 14 may contain an ink ribbon 18 of a single colour, for example black, blue or red. Alternatively, the ink ribbon 18 may be of more than one colour so as to allow two or more colours to be printed. In one embodiment the ink ribbon 18 may have four colours: cyan, magenta, yellow and black. This allows full colour images to be printed. By combining cyan, magenta and yellow in varying quantities, any desired colour can be achieved. Black could be achieved by combining cyan, magenta and yellow but it is preferred that a separate black part of the ribbon 18 be provided as this is able to give a denser tone than a combination of cyan, magenta and yellow.

Figure 5:
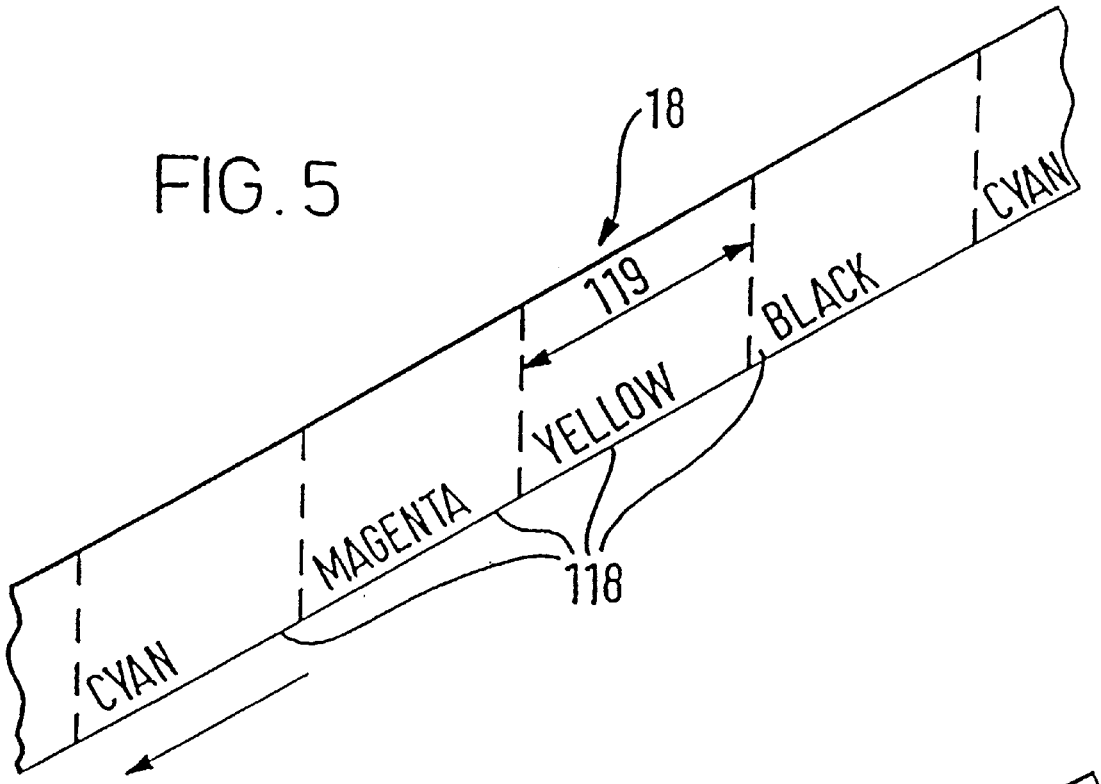
FIG. 5 shows a first ink ribbon for use in embodiments of the present invention.

The ink ribbon 18 may have the configuration shown in FIG. 5. In this embodiment, the ink ribbon 18 has panels 118 of cyan, magenta, yellow and black arranged in sequence. Each colour is printed in sequence with successive printing passes of the print head 10 across the image receiving tape 28. Each panel 118 would have a length equal to or slightly larger than the width of the image receiving tape. The ink ribbon 18 is advanced stepwise with each step corresponding to a distance generally equal to the length 119 of each panel 118. Alternatively, the ink ribbon could be advanced continously. With this ink ribbon 18, four printing passes of the print head 10 over the image receiving tape 28 are required, with the ink ribbon 18 being advanced four times, before the image receiving tape 28 itself is advanced one step. The distance of each step of the image receiving tape 28 corresponds to the width of the ink ribbon 18 or height of the column of printing elements the print head 10 whichever is smaller. Thus for each printing pass of the print head 10, the ink ribbon 18 is advanced by one step so that the region of the image receiving tape 28 on which an image is currently being printed is overlain, in succession, by panels 118 of the ink ribbon 18 of each of the four colours to thereby achieve full colour printing.

Figure 6:
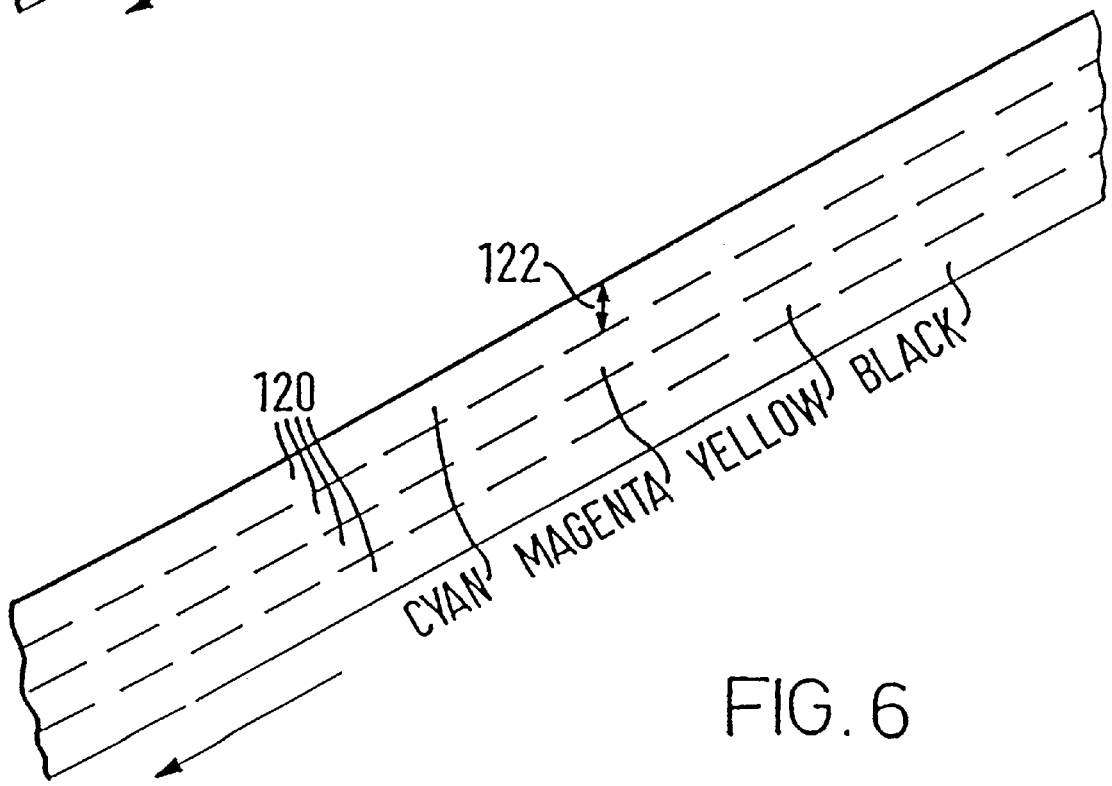
FIG. 6 shows a second ink ribbon for use in embodiments of present invention.

An alternative configuration of an ink ribbon 18 having four colours, that is cyan, magenta, yellow and black is shown in FIG. 6. In this embodiment the ink ribbon 18 has four lengthwise bands 120 of cyan, magenta, yellow and black. As the print head 10 passes across the image receiving tape 28, printing of the four colours takes place simultaneously on the image receiving tape 28 but at different locations corresponding to the different bands 120 of the ink ribbon 18. The image receiving tape 28 is advanced with every printing pass of the print head 10 by a distance corresponding to the width 122 of each of the bands 120 of the ink ribbon 18. In a similar way to that described in relation to FIG. 5, full colour printing can be achieved with the ink ribbon 18 of FIG. 6.

In this latter embodiment, the ink ribbon cassette 14 could house four separate ribbons of cyan, magenta, yellow and black instead of one ribbon 18 having all four colours. Alternatively, these four ribbons could be housed in their own cassettes. However, the general principle of operation remains unchanged.

The colours need not of course be cyan, magenta, yellow or black but can be any suitable colours. Fewer than or more than four colours can also be used.

In some embodiments of the invention, means would be provided to ensure that the correct portion of ink ribbon was over a given area of the image receiving tape. For the ink ribbon where the coloured panels extend longitudinally, the regions between two colours could be detected to ensure that the image receiving tape is advanced by the correct distance. These sensor means may take the form of a LED or the like which emits light which is reflected from the surface of the ink ribbon. From the degree of reflection, the boundaries can be detected. Alternatively, the ink ribbon itself may be provided with indicating means which can be detected in order to determine the boundaries between the colours. Similar sensing means can be used with the ink ribbon shown in FIG. 5. The sensing means described can be used to control the movement of the ink ribbon and the image receiving tape.

The tape printing apparatus may have two modes of operation. In the first mode of operation, a monochrome image is printed. The print head will pass over each part of the image receiving tape substantially only once. In a second mode of operation, a multicolour image is printed. In this second mode of operation, the print head will pass over each part of the image receiving tape n times, where n is the number of different colours of the ink ribbon.

The drive/cut mechanism 6 comprises a driver roller 30 which, as will be described later, cooperates with a surface 54 adjacent the supply of lamination tape 48 of the tape holding case 8 and is driven in the direction of arrow E by a drive mechanism (not shown). This may be the same drive mechanism which is used to move the print head 10 and the ink cassette 14. However, it is preferred that separate drive mechanisms be provided to drive the print head 10 and drive roller 30 as this avoids unnecessary complexity. The drive roller 30 has a length which generally corresponds to that of the platen 12. The drive roller 30 is arranged to drive the image receiving tape 28 from the tape holding case 8 through the print zone 24. Additionally, the drive roller 30 also drives the laminating tape 48 from the tape holding case 8 and applies the laminating tape 48 to the image receiving tape 28 after an image has been applied thereto and drives the resulting image and laminating tape combination 67 towards a tape exit. However, this will be described in more detail hereinafter.

The drive/cut mechanism 6 also comprises a cutting arrangement 32 which can be seen from FIG. 2. The cutting arrangement 32 has a blade 34 mounted in a cutter support 36. The cutting arrangement 32 further comprises a cutting surface 38 against which the blade 34 acts to thereby cut the resulting image and laminating tape combination 67. Alternatively, the surface 38 may have a slot into which the blade 34 moves to cut the resulting image and laminating tape combination 67. The drive roller 30 and the guide rails 16 are supported by respective mounting members 35*a* and *b*. As will be appreciated drive roller 30 is arranged to rotate relative to the mounting members 35*a* and *b* whilst the guides rails 16 are fixedly mounted thereto. Any suitable arrangement for mounting the drive roller 30 and the guide rails 16 to the mounting members 35*a* and *b* may be used. The mounting members 35*a* are each also arranged to accommodate the drive mechanism for the drive roller 30 and the drive mechanism for moving the print head 10 and ink cassette 14 respectively. The mounting members 35*a* and *b* which support the drive roller 30 also support the platen 12.

In order to facilitate the insertion and removal of the tape holding case 8, the pressure from the drive roller 30 and the spring loaded platen 12 has to be released and a mechanical clearance has to be provided between the print head 10 and the platen 12. A first part 61 of the tape printing apparatus 2 which supports the pressure platen 12 and the drive roller 30 is hingedly mounted to a second part 63 of the tape printing apparatus 2 which supports the print head 10 (see FIG. 2). In the interests of clarity, the portions of the housing defining the two parts 61 and 63 is not shown in FIGS. 1 or 3. The first part 61 includes the mounting members 35*a* and *b* for the drive roller 30 and pressure platen 12 whilst the second part 63 includes the mounting members 35*a* and *b* for the guide rails 16. The first part 61 is arranged to pivot about an axis 60, defined by the hinged mounting, relative to the second part 63. When the two parts 61 and 63 are separated, the tape holding case 8 can be inserted and removed from the tape printing apparatus 2. The tape holding case 8 may be inserted either in the direction of arrow C or in the direction of arrow D depending on the width of the image receiving tape 28 being used. Direction C is more practical for wider tapes whilst direction D is more practical for narrower tapes. The tape printing apparatus 2 may be arranged such that the tape holding case 8 can be inserted in only one of directions C or D. The tape printing apparatus is shown in FIG. 2 in its operational configuration.

Figure 7:
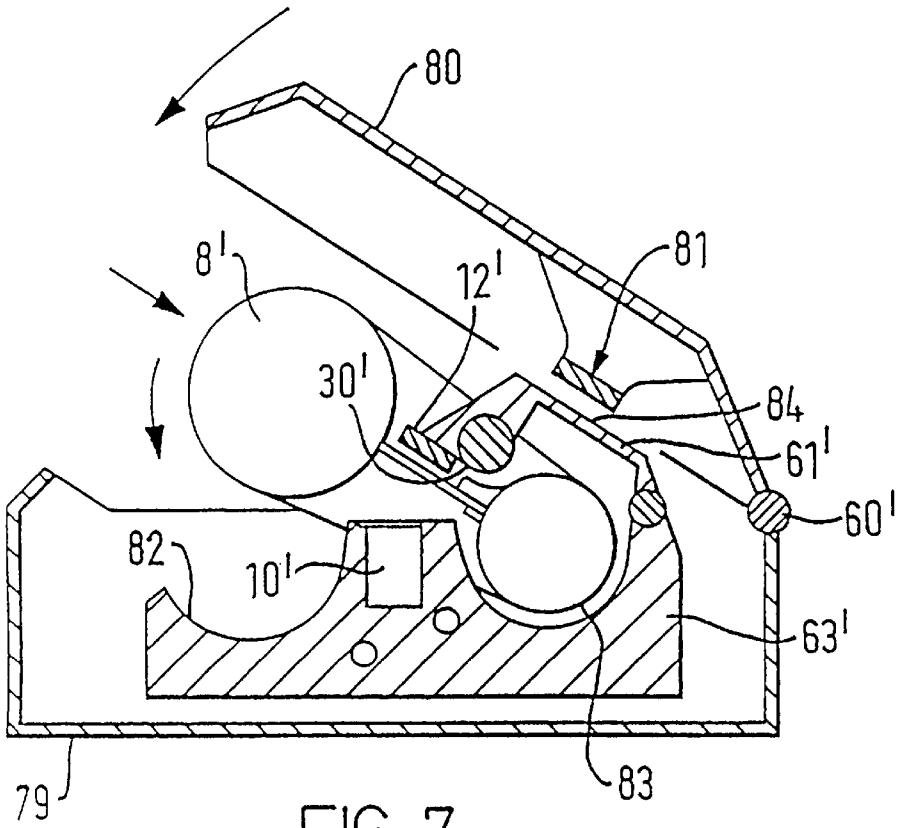
FIG. 7 shows a cross-sectional view of a second embodiment of the present invention.

Reference will now be made to FIG. 7 which shows a second embodiment of the invention in which alignment of the pressure platen 12 and drive roller 30 with other parts of the tape printing apparatus 2 can be achieved. Those parts which are shown in relation to FIGS. 1 to 3 are indicated in FIG. 7 by the same reference number followed by a dash. In particular, FIG. 7 shows a variation of the embodiment of FIGS. 1 to 3 in which correct alignment of the pressure platen 12' and driver roller 30' is ensured when the tape printing apparatus is in its operational configuration.

The tape printing apparatus has a first part 61' which supports the pressure platen 12' and drive roller 30' and a second part 63' which supports the print head 10'. The first part 61' and the second part 63' are hingedly mounted to each other about pivot axis 60'. The second part 63' is provided with two longitudinally extending semicircular cut-out portions 82 and 83 which are arranged to accommodate the image receiving tape supply and the laminating tape supply respectively of the tape holding case 8' when the tape printing apparatus is in the operational configuration. The first and second parts 61' and 63' are received in ahousing 79 which has a lid 80. The tape holding case 8' is inserted into tape printing apparatus when the lid 80 is fully opened and pushed down so that the tape supplies and are received in the cut-out portions 82 and 83 respectively of the tape printing apparatus. The lid 80 is provided with a pressure pad 81 which as the lid 80 is being closed contacts a cooperating surface 84 of the first part 61' and urges the first part 61' downwardly towards the tape holding case 8' accommodated in the cut-out portions 82 and 83 and the print head 10'. When the lid 80 is fully closed, the pressure pad 81 acts against the first part 61' and ensures that the pressure platen 12' and the drive roller 30' are in the correct position relative to the print head 10' and the tape holding case 8'. Thus closure of the lid 80 effectively ensures that the operational configuration of the two parts 61' and 63' is achieved. A latch may be provided to hold the first and second parts 61' and 63' together so as to minimize the size of the gap between the drive roller 30' and a cooperating surface of the tape holding case 8'.

The tape holding case 8 will now be described in more detail with reference to FIGS. 1 and 2. The tape holding case 8 comprises a supply 40 of image receiving tape 28 which as can be seen from FIG. 4 has an upper or image receiving layer 64 for receiving a printed image on one of its surfaces and has its other surface coated with an adhesive layer 66 to which is secured a releasable or backing layer 62. The supply 40 of image receiving tape 28 has a protective sleeve 42 of generally cylindrical shape there around. The sleeve 42 has a slot 44 extending along its length through which the image receiving tape 28 can exit. One of the long sides of the slot 44 is surrounding by an outwardly extending wall 43 which acts to guide the image receiving tape 28 to the print zone 24. As previously discussed, the image receiving tape 28 passes in overlap with the ink ribbon 18 between the print head 10 and the pressure platen 12. As discussed above, the supply 40 of image receiving tape 28 has a maximum width generally corresponding to the length of the platen 12. The widthwise extent of print head 10 is generally much less than this maximum tape width. Accordingly, only a small proportion of the width of the image receiving tape 28 actually passes between the print head 10 and pressure platen 12 at any given time.

The tape holding case 8 also comprises a supply 46 of laminating tape 48. The laminating tape 48 as can be seen from FIG. 4 comprises a clear plastics material 68 having an adhesive layer 70 on one side. The supply 46 of laminating tape 48 is also enclosed in a protective sleeve 50, again of generally cylindrical shape. The sleeve 50 has a slot 52 directly opposite the outlet slot 44 for the image receiving tape 28 to permit the exit of laminating tape 48. One long side of the slot 52 is surrounded by an outwardly extending wall 51 which is arranged so as to protect the adhesive layer 70 of the laminating tape 48 from coming into contact with other parts of the tape printing apparatus 2. The other long side of the slot is surrounded by a generally curved wall 53. The laminating tape 48 is guided out of sleeve 50 over the curved wall 53. The laminating tape 48 is guided over curved wall 53 with its adhesive layer 70 uppermost so that the adhesive layer 70 does not come into contact with the tape holding case 8.

The sleeve 50 further comprises a curved portion 54, on its outer surface, adjacent the curved wall 53 of the sleeve outlet slot 52. The curved portion 54 extends along the length of sleeve 50 and has a curvature such that the drive roller 30 cooperates against this curved portion 54 to drive the image receiving tape 28 and the laminating tape 48 through to the cutting mechanism 32. The cooperation between the drive roller 30 and curved portion 54 urges the adhesive layer 70 of the laminating tape 48 to adhere to the upper surface of the image receiving layer 64 of the image receiving tape 28. The curved portion 54 has a greater wall thickness than the rest of the sleeve 50 to provide increased resistance to deformation to ensure that a sufficient pressing force is achieved between the curved portion 54 and the driver roller 30. Additionally, the increased thickness of the curved portion 54 leads to an increased radius of the curved wall 53. This may reduce the friction between the laminating tape 48 and the curved wall 53. However, it should be appreciated that embodiments of the invention where the curved portion 54 does not have an increased thickness as compared to the rest of the sleeve 50 may also perform well. The sleeve 50 may in some embodiments not have the curved portion 54. In this situation, the drive roller 30 would cooperate with the convex surface of the sleeve 50. The drive roller 30 in this embodiment is fixedly mounted for rotation about a fixed axis. However, in some embodiments, the drive roller 30 may be resiliently mounted or biased towards the curved portion 54 of the tape holding case 8 to provide the necessary pressing force to cause the laminating tape 48 to adhere to the image receiving tape 28.

Alternatively or additionally, the sleeve 50 for the laminating tape 46 may be designed so that the curved portion 54 is biased in a direction towards the drive roller 30 to help ensure that a sufficient pressing force exists between the drive roller 30 and the curved portion 54 of the sleeve 50 to press the laminating tape 48 and the image receiving tape 28 together.

The supply 40 of image receiving tape 28 is arranged above the supply 46 of the laminating tape 48. These two tape supplies 40 and 46 define therebetween an aperture 49 so that in use the print head 10 and spring loaded platen 12 are arranged so as to be between the tape supplies 40 and 46. The tape supplies 40 and 46 along with their respective sleeves 42 and 50 are supported at either end by support members 56 and 58. These support members 56 and 58 are both rigid and have support posts (not shown) for supporting the two tape supplies 40 and 46. Sleeves or spools (not shown) are arranged to be received on the support posts to allow the rotation of the tape supplies 40 and 46. The support posts and sleeves or spools do not necessarily extend the entire width of the tape supplies 40 and 46 but, may for example each extend into the respective tape supply 40 and 46 for between an eigth and a quarter of the width of the tape supply 40 and 46. It will be appreciated that in some embodiments the support posts and spools or sleeves may extend across the entire width of the tape supply 40 and 46 whilst in other embodiments the spools or sleeves and support posts may extend only a small distance into the respective tape supply 40 and 46. Any other suitable mechansim can alternatively be used for supporting the tape supplies 40 and 46 on support members 56 and 58.

As can be seen particularly clearly from FIG. 1, support members 56 and 58 have different constructions. However, embodiments of the present invention can be arranged such that the two support members have the same or a similar construction. Support member 56 is a substantially flat member having an elongated ovoid shape. This shape of support member 56 is able to provide strong support. On the other hand, support member 58 is generally bar-like and the plane of the larger surface 57 of the support 58 extends perpendicular to the plane containing the ends of the tape supplies 40 and 46. The shape of the support member 58 acts to ensure that the tape holding case 8 is correctly located in the tape printing apparatus 2 when the two parts 61 and 63 of the tape printing apparatus 2 are in the closed position, as shown in FIG. 2. Additionally, the shape of support member 58 facilitates the insertion of the tape holding case into the tape printing apparatus 2, particularly when the tape holding case 8 is inserted into the tape printing apparatus 2 in the direction of arrow D. The support member 58 is arranged to be received between parts 61 and 63 of the tape printing apparatus 2 and in particular between the respective mounting members 35*a* of the first and second parts 61 and 63. In contrast, support member 56 lies, in use, outside the two parts 61 and 63 of the tape printing apparatus 2 when in the closed position or operational configuration, shown in FIGS. 1 and 2.

The sleeves 42 and 50 for the tape supplies 40 and 46 are mounted so as to be immovable with respect to the support members 56 and 58. This may be achieved by providing guide grooves for the sleeves 42 and 50 on the inner surfaces of the support members 56 and/or 58. Alternatively or additionally, the sleeves 42 and 50 may be bonded in any suitable manner to the support members 56 and 58. The sleeves 42 and 50 need not be bonded to both support members 56 and 58 but only one thereof.

In one preferred embodiment, the sleeves 42 and 50 are made of a resilient material such as a suitable plastics material which can be snap fitted over the supplies 40 and 46 of tape. Any suitable mechanism may be provided for maintaining the snap fitted sleeves 42 and 50 in the correct position. For example, protrusions may be provided on the ends of sleeves 42 and 50 which are received in corresponding recesses provided on for example support member 56. In certain applications, it may be possible to re-use sleeves 42 and 50 thus reducing the overall costs for replacing a tape holding case 8. The sleeves 42 and 46 may alternatively be of a generally rigid material.

The tape holding case 8 accommodates equal lengths of image receiving tape 28 and laminating tape 48. However, the diameter of the image receiving tape supply 40 is bigger than that of the laminating tape supply 46 as the image receiving tape 28 has the additional backing layer 62 adhered thereto. The widths of the image receiving tape 28 and the laminating tape 46 are the same.

As can be seen particularly from FIG. 2, the region where the image is printed on said tape is adjacent the region where the tape is cut. This is achieved as the tape supplies 40 and 46 are arranged respectively generally above and below the print head 10 and the cutting arrangement 32. The print head 10 is also arranged between the tape supplies 40 and 46, in aperture 49 which assists in reducing the distance between the printing zone 24 and cutting arrangement 32. Thus the size of the leading and trailing margins of a label can be minimised if required. Unnecessarily long leading margins and trailing margins lead to the wastage of tape.

The apparatus shown in FIGS. 1, 2 and 3 may be provided with a housing of the type shown in relation to the embodiment of FIG. 7. This housing may have an opening which allows the insertion and removal of the tape holding case 8. The apparatus 2 may also have a data input means for allowing an image to be printed to be input. Typically this data input means will take the form of a keyboard. A display may also be provided to allow the input image to be viewed as it is input and/or prior to commencement of the printing operation.

Figure 4:
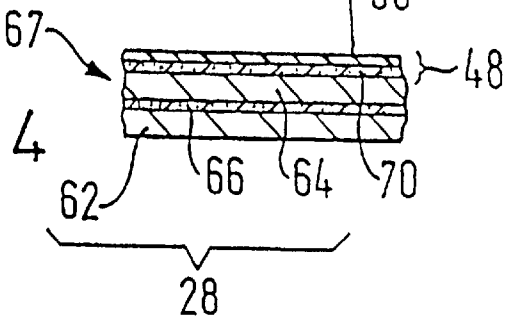
FIG. 4 shows a cross-section through the tape in the form in which it emerges from the tape printing apparatus.

Before describing the operation of this tape printing apparatus 2, reference will now be made to FIG. 4 which shows the construction of a tape exiting the above-mentioned apparatus 2. The resulting tape 67 comprises backing layer 62 and image receiving layer 64. The layer of adhesive 66 releaseably secures the image receiving layer 64 to the backing layer 62. Layers 62, 64, 66 comprise the image receiving tape 28. Secured to the upper surface of the image receiving layer is the clear plastics layer 68. The clear plastics layer is secured to the image receiving layer 64 by means of the adhesive layer 70. The adhesive layer 70 and clear plastics layer 68 together consitute the laminating tape 48.

The operation of the above-mentioned apparatus 2 to provide a label will now be described. As described earlier, to insert a tape holding case 8 into the tape printing apparatus 2, the first part 61 of the tape printing apparatus 2 is pivoted away from the second part 63 about pivot axis 60. This allows the tape holding case 8 to be inserted into the apparatus 2. The first part 61 of the tape printing apparatus 2 is then moved back to adopt the closed position shown in FIG. 2. Thus, the drive roller 30 adopts a position in which it cooperates with the curved surface 54 adjacent the supply of lamination tape 48 of the tape holding case 8. The image receiving tape 28 is passed through the print zone 24 defined between the pressure platen 12 and thermal print head 10. As discussed previously the ink ribbon 18 lies between the print head 10 and the image receiving tape 28.

During a print operation, the print head 10 moves in the direction of arrow B along the width of the image receiving tape 28. In particular, as the print head 10 tape moves from left to right across the image receiving tape 28 an image is printed on the surface of the image receiving tape 28. The image receiving tape 28 is, whilst an image is being printed thereon, stationary. An image is printed on the image receiving tape 28 by selective activation of printing elements on the thermal print head 10. This causes the ink ribbon 18 to lay down an image on the image receiving tape 28. In particular, the print head 10 is controlled to print an image on the image receiving tape column by column. The print head 10 acts against the spring loaded platen 12 to ensure that an image with good definition is printed on the tape 28. The compliant surface 17 ensures that an even printing tone can be achieved. The image receiving tape 28 overlaps at right angles with the ink ribbon 18 so that the longitudinal length of the ink ribbon 18 is at right angles to that of the image receiving tape 28.

As the print head 10 is returned to its initial position moving from right to left back across the tape, the print head 10 does not print an image onto the tape. The return path of the print head 10 is the reverse as that taken by the print head 10 when it is printing. At the same time that the print head 10 is being moved back to its initial position, the tape 28 is advanced in order to receive the next part of the image. In other words, the image receiving tape 28 is advanced during the non-printing return of the print head 10. As the ink cassette 14 is mounted with the print head 10 on the guide rails 16, the ink cassette 14 scans the image receiving tape 28 together with the print head 10.

It will be appreciated that the apparatus 2 can alternatively be arranged to print as the print head 10 moves from right to left and to move the image receiving tape 28 as the print head moves from left to right. In yet another variation, the print head 10 can print as it moves right to left, be kept on the left side whilst the image receiving tape is advanced, print as the print head 10 moves from left to right and then kept at the right side while the image receiving tape 28 advances. The image receiving tape 28 may in certain embodiments be arranged to move as an image is being printed. In these embodiments, the image receiving tape 28 may be continuously moving. However, where multiple colour printing is taking place, it is preferred that the image receiving tape be stationary during printing.

In order to advance the tape during the non-printing return of the print head 10, drive roller 30 is rotated. At the same time as the drive roller 30 drives the imagereceiving tape 28 through the tape printing apparatus 2, it also feeds laminating tape 48 through the tape printing apparatus 2 and the adhesive layer 70 of the laminating tape 46 is urged against the surface of the image receiving tape 28 which receives the image. The image receiving tape 28, coated with laminating tape 48 is fed to the cutting arrangement 32 where blade 34 cuts the combined tape 67 to the desired length to provide a label.

The tape printing apparatus 2 embodying the present invention can be arranged to be used with a range of image receiving tapes 28 with different widths. Sensors may be provided to determine the width of the tape. Signals from these sensors may be used to determine the extent of the path of movement of the print head 10. Alternatively, a manual switch or the like may be used to indicate to the apparatus 2 the size of tape which is being used. Alternatively, the print head 10 can be arranged to always scan a fixed distance corresponding to the maximum width of image receiving tape 28 to be received in the tape printing apparatus 2. A print head controller or other suitable controller would then be arranged to ensure that an image was only printed on the image receiving tape 28 in accordance with the width of tape detected.

A computer controller (not shown) is provided to control the relative positions of the print head, the ink ribbon and the image receiving tape so that the respective different coloured images are aligned in the colour printing mode.

The above-mentioned embodiment can of course be modified in a number of different ways. For example, a stationary full width ink cassette with tape stretched across the whole of the width of the image receiving tape 28 could be used instead of the smaller ink cassette 14 which is mounted to move with the print head. Additionally, certain embodiments of the present invention could be provided with a single tape holding case which not only holds the image receiving tape 28 and the laminating tape 48 but also the ink ribbon 14.

In the present embodiment, the image has been printed on an image receiving tape 28 with a clear laminating layer 48 placed on top of the printed image. However, in certain embodiments of the present invention, it would be possible to print the image on the reverse side of a clear tape. The printed image would of course have to be a mirror image to allow the correct image to be viewed from the upper side of the tape. The laminating tape 48 to be applied to the underside of the tape would, in those circumstances, not necessarily be clear and may be opaque. Additionally, instead of the clear transparent laminating tapes 48 discussed hereinbefore, a slightly opaque tape may be used provided of course the print can be seen as required. Furthermore, it will be appreciated that the image receiving tape 28 and the laminating tape 48 need not be in the same tape holding case 8 but can each be provided in separate tape holding cases.

In one preferred embodiment, the tape holding case 8 would be reuseable and the user would merely replace the tape supplies 40 and 46. This would of course involve ensuring that the various components of the tape holding case 8 can be disassembled to allow insertion of the supply of tape and reassembled for example, by various snap fit mechanisms. This embodiment may have particular advantages in, for example, industrial applications.

In embodiments of the invention which are designed to be used with narrow width image receiving tape 28, only a single support member for the tape supplies may be provided. However, the two support system is preferred for those embodiments which use larger widths of tape.

Whilst the present embodiment has been described as using a thermal print head 10 in combination with an ink ribbon 18, any other suitable method of printing can also be used. For example, the ink ribbon 18 could be dispensed with and a direct thermal process used in which the thermal print head 18 directly contacts the image receiving tape 28 to print an image thereon. If the direct thermal image receiving tape is temperature sensitive, it may be possible to achieve colour printing with a direct thermal image receiving tape without receiving an ink ribbon. This could involve controlling the temperature of the print head to achieve the different colours.

In one variation on the embodiment shown, the drive roller 30 may be arranged to cooperate with a further roller, rather than the curved portions of the sleeve of the laminating tape supply in order to apply the laminating tape to the image receiving tape. This further roller can be a passive roller (not positively driven) or can be a driven roller. This can avoid the need for the curved portion 54. This further roller may be external or internal to the tape holding case.

Embodiments of the present invention may have applications to non-laminating tape printing apparatus. In these embodiments the laminating tape supply would be omitted from the tape holding case. In those embodiments, the tape holding case may either contain only a supply of image receiving tape or also contain a supply of second type of tape in addition to the image receiving tape.

In one modification to the previously described embodiments, the thermal printhead and ink cassette are replaced with an ink jet cassette. The pressure platen can be dispensed with in this modification as ink jet printing is a non-contact process. The image receiving tape would be of a material suitable for the ink jet printing method. In this regard, reference is made to FIG. 8 which shows a modified tape printing device 2' which is arranged to use a ink jet cassette 200 instead of the thermal printhead used in the previous embodiments. A similar scanning mechanism 202 to that described in relation to the first embodiment is used in order to cause the ink jet cassette to scan across the image receiving tape 28.

Figure 8:
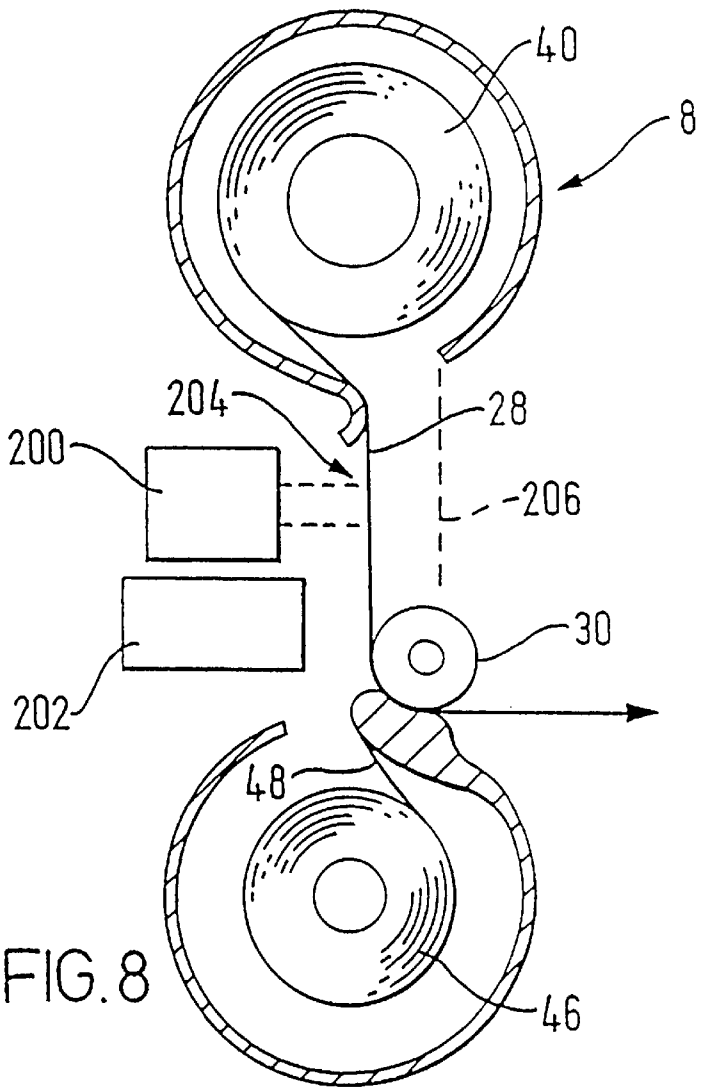
FIG. 8 shows a modified tape printing apparatus which uses an ink jet print head instead of a thermal print head.

The construction of of the tape holding case used in this latter embodiment may have exactly the same construction as that shown in the previous embodiments. However, the tape holding case 8 may be modified so that the aperture does not extend completely between the two tape supplies 40 and 46 respectively. In particular, an opening 204 may be provided as illustrated in FIG. 8. The opening 204 is between the two tape supplies 40 and 48 but is only open on the side on which the ink jet cassette 200 is provided. On the other side of the image receiving tape 28 to the ink jet cassette, the opening 204 is closed off by backing member 206.

What is claimed is:

1. A tape holding case for use with a tape printing apparatus, said tape holding case comprising:

a first case having a supply of image receiving tape to which an image is to be applied;

a second case having a supply of protective tape to be applied to the image receiving tape on a surface of the image receiving tape to which an image has been applied by said tape printing apparatus; and a cooperating surface which in use is arranged to cooperate with a drive means of the tape printing apparatus to drive the image receiving tape through the tape printing apparatus and to apply the protective tape to the image receiving tape, said cooperating surface being on an external surface of one of said casings for at least one of said tape supplies.

2. A tape holding case as claimed in claim 1, wherein said cooperating surface is curved so as to cooperate with a roller.

3. A tape holding case as claimed in claim 1, comprising a support member arranged to support said first casing and said second casing.

4. A tape holding case as claimed in claim 3, wherein said first and second casings are substantially cylindrical.

5. A tape holding case as claimed in claim 3, wherein said cooperating surface is provided on one of said first or second casings and said one casing is thickened in the region of said cooperating surface.

6. A tape holding case as claimed in claim 3, wherein at least one of the tape supplies is guided out of its casing by a curved wall portion of the respective casing.

7. A tape holding case as claimed in claim 1, wherein said cooperating surface is adjacent an exit for at least one of said tape supplies.

8. A tape holding case as claimed in claim 1, wherein said supply of image receiving tape and said supply of protective tape are arranged on either side of an opening of the tape holding case, wherein said opening is sized and arranged to receive a printing mechanism to print an image on said image receiving tape as it traverses said opening.

9. A tape printing apparatus in combination with a tape holding case as claimed in claim 1, wherein said tape printing apparatus comprises drive means, said drive means being arranged to act against the cooperating surface of said tape holding case to drive the image receiving tape through the printing apparatus, the drive means and the cooperating surface being arranged to apply the protective tape to the image receiving tape.

10. A combination as claimed in claim 9, wherein said tape printing apparatus further comprises means for receiving said tape holding case, a printing mechanism for printing an image on said image receiving tape supplied by the tape holding case, and a cutting location at which said image receiving tape is cut after an image has been printed thereon.

11. A combination as claimed in claim 10, wherein said drive means and said cooperating surface are separable to define a gap between the drive means and said surface whereby the image receiving tape can be placed between said drive means and said cooperating surface.

12. A combination as claimed in claim 9, wherein said drive means comprises a rotatable roller which drives said image receiving tape through said apparatus.

13. A combination as claimed in claim 9, wherein said support member of the tape holding case is arranged in use to be held in place between two parts of said tape printing apparatus, said two parts of said tape printing apparatus being arranged to be separable.

14. A combination as claimed in claim 9, wherein said tape printing apparatus comprises first and second parts with said printing mechanism being mounted in said first part and said drive means being mounted in said second part, said first and second parts being movable to allow insertion of said image receiving tape between said first and second parts and to allow cooperation between said cooperating surface and said drive means.

15. A combination as claimed in claim 9, wherein said cooperating surface and said drive means are biased towards each other to ensure sufficient cooperation between them.

16. A combination as claimed in claim 9, wherein said tape printing apparatus comprises:

a platen against which the image receiving tape is retained during printing.

17. A combination as claimed in claim 16, wherein said tape printing apparatus comprises first and second parts with said printing mechanism being mounted in said first part and said platen being mounted in said second part, said first and second parts being separable to allow insertion of said image receiving tape between said printing mechanism and said platen.

18. A combination as claimed in claim 16, wherein a surface of the platen against which the image receiving tape is retained during printing is substantially planar.

19. A combination as claimed in claim 16, wherein said platen is non-rotatable.

20. A combination as claimed in claim 16, wherein said at least one of the printing mechanism and the platen is biased towards the other of said printing mechanism and platen.

21. A combination as claimed in claim 16, wherein said printing mechanism is movable across the width of the image receiving tape to thereby print an image thereon.

* * * * *